United States Patent [19]

Lessard

[11] Patent Number: 4,619,385

[45] **Date of Patent: * Oct. 28, 1986**

[54] PANTS RACK

[76] Inventor: Roy W. Lessard, 19453 Kinai Rd., Apple Valley, Calif. 92307

[ * ] Notice: The portion of the term of this patent subsequent to Jul. 2, 2000 has been disclaimed.

[21] Appl. No.: 350,075

[22] Filed: Feb. 18, 1982

[51] Int. Cl.[4] ..... A47J 51/14

[52] U.S. Cl. ..... 223/96; 211/113; 211/124

[58] Field of Search ..... 223/96, 95, 91, 88; 211/113, 124

[56] References Cited

U.S. PATENT DOCUMENTS

| | | | |
|---|---|---|---|
| 2,244,355 | 6/1941 | Britner | 223/91 |
| 2,672,989 | 3/1954 | Creveling et al. | 211/113 |
| 2,717,108 | 9/1955 | Schaerer | 223/91 |
| 3,272,464 | 9/1966 | Jacobson | 211/124 X |
| 3,853,225 | 12/1974 | Gegauff | 211/124 X |
| 4,275,826 | 6/1981 | Lessard | 223/96 |

FOREIGN PATENT DOCUMENTS

| | | | |
|---|---|---|---|
| 143823 | 1/1954 | Sweden | 223/91 |

*Primary Examiner*—Robert Mackey

[57] ABSTRACT

A rack having a longitudinal base member with a longitudinal flexible material holding member secured to the side of the base member by pivotal connection at one end of the holding member allowing a pair of pants to be inserted through the opening between the other end of the holding and base members. A wedge bracket is located on the base member near the free end of the holding member which forces the holding member against the base member thereby providing a pants gripping force when the pants wieght rotates the holding member down.

1 Claim, 3 Drawing Figures

PANTS RACK

BACKGROUND OF THE INVENTION

There are known pants supporting devices, such as the well known clothes hanger or the pants supporting device having a pair of spring biased members that grip the pants just above the cuffs of the pants to support the pants in a vertical position. It is well known to those who have used the known pants supporting devices and clothes hangers, that these devices have many disadvantages. Pants tend to slip off the horizontal member of a clothes hanger. Further the horizontal member is connected at each end and unless there is adequate width dimensions, the side member causes folds in the edges of the pants. Also, it is difficult to correctly align the creases in the pants and then position the pants with the creases aligned on the horizontal bar of the clothes hanger. The other known pants supporting devices using the spring biased members, have the disadvantage of allowing the pants to slide therethrough forcing the cuffs against the support. This creases folds into the cuffs in an undesirable manner. Still further, many pants are made today without cuffs and are thus difficult to support on the known pants supporting devices.

Thus it is advantageous to have a new pants rack that supports pants in the manner that they are not creased by the supporting means, that is easy and simple to construct and operate, that can be permanently installed easily and inexpensively in fixed positions, that securely holds the pants whether they have cuffs or not in a supported position, that works well on pants weighted down with belts and other heavy objects, and on which pants rack it is easy to hang the pants with the creases aligned.

SUMMARY OF THE INVENTION

The embodiment of this invention comprises a base member having a longitudinal and substantially rectangular shape. A longitudinal round rod pants holding member is pivotally supported at one of its ends to the base member such that the holding member extends longitudinally along the side. A wedge bracket located on the base member to engage the free end of pivoted longitudinal holding member is shaped to provide a mechanical locking force.

The invention incorporates a new method of hinging a longitudinal pants holding member at one end such that pants may be easily draped and removed from such support. The invention provides a simple mechanical system whereas the pants weight provides the frictional locking force and thereby prevents slippage of pants with and without cuffs.

The basic concept is to provide a longitudinal holding member hinged at one end, that can be rotated up at an angle to provide space to allow pants to be slipped easily over the open end. The weight of the pants is then utilized to rotate the longitudinal holding member down and into a locked position. As the longitudinal holding member is rotated down, it makes contact with a wedge bracket which provides a high force moving the longitudinal holding member toward the base support member thereby locking the pants in place.

The base member may be fastened permanently to walls such as in hotels or motels to prevent removal, or supported by other typical well known wire and wood hanging devices at a point substantantially corresponding to its center of gravity so that the structure hangs in a substantially horizontal position.

Thus, it is the object of this invention to provide a new and improved pants rack that will support pants of any style and not allow them to slip off.

It is another object of this invention to provide a new and improved pants rack that is simple in operation, is inexpensive to construct, is durable in construction, and that does not require springs or other resilient members for its operation.

It is another object of this invention to provide a new and improved pants rack that can be either supported conventionally by hangers or permanently fixed to walls.

It is of course envisioned that the scope of the invention encompasses not only a means to support a pair of pants but also any flexible material which will drape over the longitudinal holding member.

Other objects and many intended advantages of this invention will become more apparent upon reading the following detailed description and examining the drawings which:

DETAILED DESCRIPTION OF THE INVENTION

There are four critical elements associated with this invention.

Figure 1:
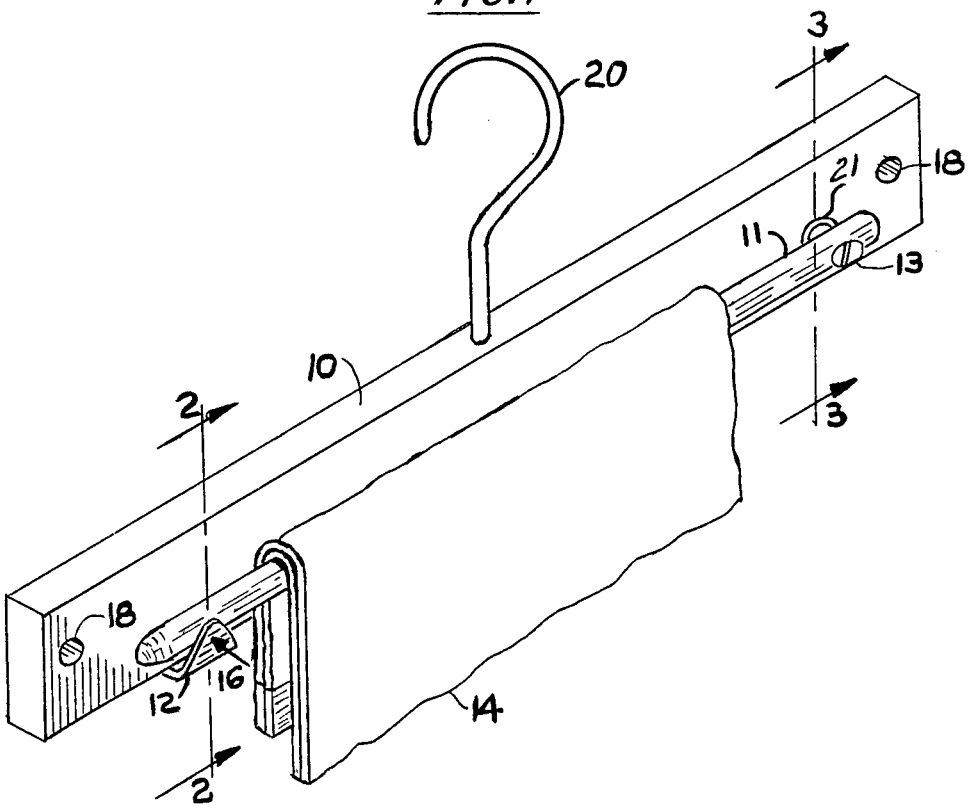
FIG. 1 is a perspective view of the embodiment of the invention showing a longitudinal pants holding member secured and hinged to a base support member.

10-BASE SUPPORT MEMBER: The base support member is a rectangular section that provides the base for hinging the longitudinal holding member and anchoring the wedge bracket. It may be fastened permanently to a wall as shown in FIG. 1 utilizing mounting holes 18, or supported by various hangers and hanging devices as shown by hanger 20.

11-LONGITUDINAL PANTS HOLDING MEMBER: This member is a round red, hinged at one end, aver which the pants are draped.

12-WEDGE BRACKET: This bracket is attached to the base support member and because of its shape provides a force which locks the draped pants between the longitudinal holding member 11 and base support 10.

21-FRICTION SPACER: This spacer provides friction to hold the longitudinal holding member 11 in an up and open position for easy draping of pants.

Figure 3:
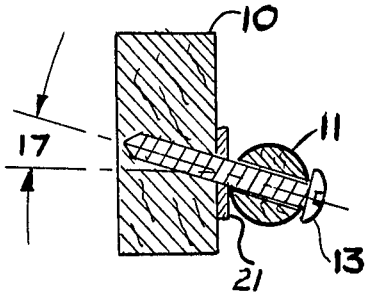
FIG. 3 is a sectional view showing the canted pin which hinges the longitudinal holding member to the base member and the friction spacer which holds said longitudinal member up in the open position.

In operation, the longitudinal holding member 11 is first rotated up about pin 13 and held up by the friction spacer 21. As shown in FIG. 3, the hinge pin 13 is set at an angle 17 which makes member 11 pivot up and away from support 10, thereby creating gap 15 between members 11 and 10. A pair of pants is then easily inserted from one end and draped over longitudinal holding member 11 using gap 15 created by the upper rotation of member 11.

Figure 2:
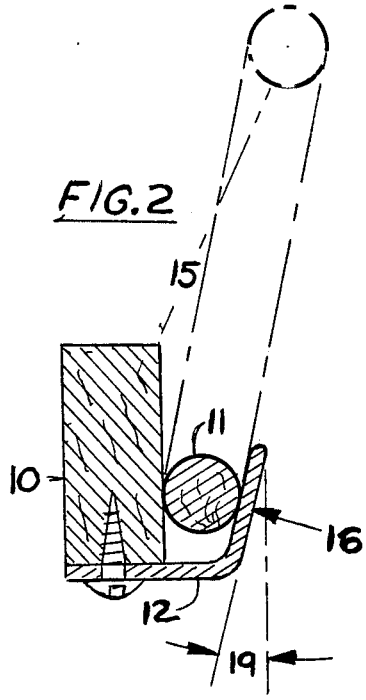
FIG. 2 is a sectional view showing the wedge bracket which generates the locking force.

The weight of the draped pants now rotates the longitudinal holding member 11 about hinge pin 13. The downward rotation causes the wedge bracket to create a force at a location 16 in FIG. 2 between members 11 and 10 due to wedge angle 19, which prevents pants slippage and increases as weight increases. Removal of pants 14 is accomplished by raising the longitudinal member 11 and simply sliding pants 14 off the open end of member 11.

Having disclosed my invention, I claim:

1. A pants hanger comprising:

a base support member, rectangular in cross section, a longitudinal pants holding member, round in cross section, pivotally mounted at one end of said holding member and securely anchored to the base support member, a wedge bracket anchored to said base support member and located to engage the free end of said pivoting longitudinal holding member, and thereby forcing said longitudinal member to move towards said base support member thereby locking pants draped over said holding member, a canted hinge pin which accurately controls the pivoting motion of said longitudinal holding member in relation to said base support member and said wedge bracket, such controlled motion producing a large pants loading gap when said longitudinal member is pivoted up and a minimum gap when said longitudinal member is pivoted down, a friction spacer located at said hinge pin which acts as a hold open device for said pivoting longitudinal holding member thereby optimizing operation, a hook for supporting said base support member by a hanger assembly and mounting holes within said base support member capable of permanently fastening the pants hanger to a wall.

* * * * *